United States Patent [19]

Barnard et al.

[11] Patent Number: 4,822,175

[45] Date of Patent: Apr. 18, 1989

[54] SPLASH GUARD FOR A FOOD MIXER

[75] Inventors: John K. Barnard, Bay Village; Richard D. Boozer, Columbia Station; Sreenivasan Sankar, Middleburg Heights, all of Ohio

[73] Assignee: Vita-Mix Corporation, Cleveland, Ohio

[21] Appl. No.: 243,262

[22] Filed: Sep. 12, 1988

[51] Int. Cl.[4] ..... B01F 15/00

[52] U.S. Cl. ..... 366/347; 366/206; 366/251; 366/601

[58] Field of Search ..... 366/349, 347, 601, 244, 366/245, 247, 249, 251, 206, 279, 286

[56] References Cited

U.S. PATENT DOCUMENTS 1,559,002 10/1925 Plastino ..... 366/206

2,324,179 7/1943 Srob ..... 366/206

2,662,754 12/1953 Sharp ..... 366/347

2,710,743 6/1955 Betry ..... 366/206

*Primary Examiner*—Robert W. Jenkins

*Attorney, Agent, or Firm*—Renner, Kenner, Greive, Bobak, Taylor & Weber

[57] ABSTRACT

A splash guard (10) for a food mixer (11) having a housing from which a food agitator (17) downwardly extends including a base plate (22) having an opening (24) therein. A ring member (23) is positioned above the base plate (22) and surrounds the agitator (17). Rod members (27) carry the base plate (22) and ring member (23) so that when a cup (C) is placed below the base plate (22) and moved vertically, the base plate (22) and ring member (23) move upwardly with the rod member (27) while the agitator (17) enters the cup (C).

8 Claims, 2 Drawing Sheets

SPLASH GUARD FOR A FOOD MIXER

TECHNICAL FIELD

This invention relates to a splash guard for a food mixer, for example, of the type used to mix, directly in the serving cup, candy or other condiments into ice cream. More particularly, this invention relates to a device which surrounds the food agitator of the mixer so that when the user places a cup containing the food to be mixed into a position so that the agitator will mix the food, the mixer is activated and the food is mixed without splashing the user or the surrounding area.

BACKGROUND ART

For many years mixers with downwardly extending shafts and some type of agitator on the end thereof have been used to mix food products, such as milk shakes, in a cup. More recently, mixers with more powerful motors have been used to mix candy and other condiments into ice cream or other viscous desserts. Often this is done in a store or restaurant on a self-serve basis wherein the user fills his cup with ice cream or the desired condiments, positions the cup so that the agitator of the mixer is within the ice cream, turns on the mixer to initiate the mixing, and, for best results, moves the cup around, vertically and laterally, for total mixing.

During this rather aggressive mixing process, food items can be thrown out of the cup and splash the surrounding area or even the user himself. Moreover, such splashing almost always contaminates the exposed portions of the inside of the mixer thereby requiring frequent cleaning maintenance. In addition, unless the machine is turned off before the cup is lowered from its operating position surrounding the agitator, still more of the food clinging to the agitator is freely spun off into the surrounding environment.

Present attempts at providing splash guards for such equipment have been unsatisfactory primarily because they make the mixer cumbersome to use while still not providing complete splash protection. One common splash guard, for example, is merely a clear plastic shield which is located between the agitator and the open access front end of the mixer. The shield is usually pivotally mounted in the mixer so that the user must swing it upward and slightly out of the way to locate the cup around the agitator.

The process of using a mixer with such a splash guard can be quite cumbersome and inconvenient, particularly to the self-service user. First, the mixer is turned on to rotate the agitator and preferably with one hand the user swings and holds the guard upward for access to the agitator while the other hand positions the cup around the agitator such that the contents thereof will be mixed. Exposing the food item in the cup to an agitator which is already moving, of course, increases the probablity of splash and with the guard necessarily swung partially out of the way, complete splash protection even in one direction is not afforded. While one hand operation is possible, that is, the wrist or forearm of the hand of the user holding the cup can also maintain the splash guard partially out of the way, freeing the other hand to turn on the agitator after the cup is positioned therearound to minimize splash, such use of the wrist or forearm limits the mobility of the hand doing the mixing.

Moreover, such splash guards only protect, even in the partial way just described, the front open end of the mixer, 360° protection around the cup not being afforded, nor is there any protection around the top of the cup.

Finally, prior art splash guards have no way of assuring that the user will not accidentally allow the agitator to penetrate the bottom of the cup thereby losing the contents of the same. Such damage to the cup is a somewhat frequent occurrence particularly in view of the fact that the user's attention is focused on maneuvering the splash guard and not always on the precise location of the cup relative to the agitator. Food mixers are therefore often provided with extra devices which assure that the user will not permit the agitator to penetrate the bottom of the cup but such devices add expense to the product and are in need of constant adjustment dependent on the size of the cup being used.

DISCLOSURE OF THE INVENTION

It is thus a primary object of the present invention to provide a splash guard for a food mixer with complete splash protection extending 360° around the cup in which the food is being mixed.

It is another object of the present invention to provide a splash guard, as above, in which splash protection is also provided above the cup.

It is a further object of the present invention to provide a splash guard, as above, which is movable in operation to actuate and deactuate the motor operating the agitator of the food mixer so that the agitator does not operate until it is in the cup thereby minimizing the likelihood of splashing food out of the cup.

It is yet another object of the present invention to provide a splash guard, as above, which places a positive limit on the distance the user can move the cup upward around the agitator thereby eliminating the possibility that the agitator will penetrate the bottom of the cup.

It is a still further object of the present invention to provide a splash guard, as above, which is easily removable from the food mixer for cleaning purposes.

It is an additional object of the present invention to provide a splash guard, as above, which is easy to operate giving the user the full mobility for mixing the contents of the cup.

These and other objects of the present invention, which will become apparent from the description to follow, are accomplished by the improvements hereinafter described and claimed.

In general, a splash guard according to the present invention is to be utilized with a food mixer having a motor housing with an agitator extending downwardly from the housing. The splash guard includes a base plate having an opening therein through which the agitator may pass. A ring member is positioned above the base plate and is adapted to surround the agitator. A rod member which carries the base plate and ring member is slidably attached to the motor housing of the food mixer so that the base plate and ring member may be vertically movable with respect to the housing.

PREFERRED EMBODIMENT FOR CARRYING OUT THE INVENTION

Figure 2:
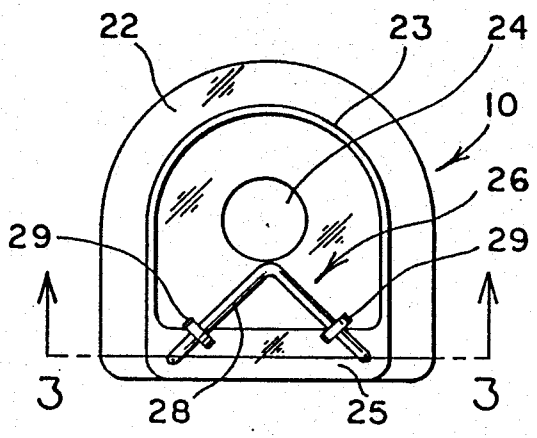
FIG. 2 is a top view of a splash guard according to the concept of the present invention.
Figure 4:
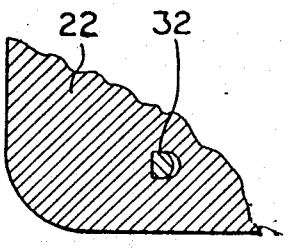
FIG. 4 is a fragmented sectional view taken substantially along line 4—4 of FIG. 3.

A splash guard, generally indicated by the numeral 10 in the drawings, is designed for use with a food mixer indicated generally by the numeral 11. Food mixer 11 includes a main housing or chamber defined by sidewalls 12, bottom 13, top wall 14 and back wall 15, with the front end 16 being open for access to an agitator 17 extending downwardly into the food mixing chamber. Agitator 17 is carried and rotated by a motor 18 positioned in an enclosed motor housing of mixer 11 defined by the upper portion of sidewalls 12, top wall 14, the upper portion of back wall 15, a bottom wall 19 and a front wall 20. A power switch 21 located on front wall 20 of the motor sub-housing connects a source of electrical power to motor 18 in a conventional manner.

Splash guard 10 includes a base plate 22 and a ring member 23 positioned above and attached to base plate 22. Both base plate 22 and ring member 23 are shown to be of a semi-oval configuration (FIG. 2) but any similar configuration would suffice with it only being important that ring member 23 totally surround agitator 17, and that base plate 22 closes off the bottom of ring member 23 except for an aperture 24 in base plate 22 of sufficient size for passage of agitator 17 therethrough. Ring member 23 is open at the top end thereof and includes a laterally extending guide flange 25 positioned toward the rear of the mixer housing when splash guard 10 is mounted therein. Both ring member 23 and base plate 22 can be made of an inexpensive clear plastic material.

Base plate 22 and ring member 23 are carried by a guide and support member generally indicated by the numeral 26, which includes two rods 27 connected at the top, as by V-shaped portion 28. Guide and support member is preferably fabricated from one continuous piece of somewhat flexible stainless steel rod which is bent into the configuration shown. Two sound and shock absorbing washers 29 are provided on the V-shaped portion 28 so as to eliminate any noise which might occur when support member 26 contacts the top 14 of mixer 11.

Figure 3:
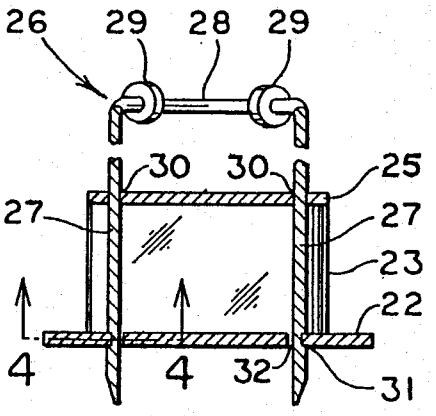
FIG. 3 is a fragmented sectional view taken substantially along line 3—3 of FIG. 2.

Rods 27 are slidably received through aligned openings (not shown) in the top wall 14 and bottom wall 19 of the motor housing and also through aligned openings 30 (FIG. 3) in ring guide flange 25. Each rod 27 is provided with a notch 31 near the bottom thereof to engage bevelled holes 32 in base plate 22. Holes 32 are slightly misaligned with the openings 30 in ring guide flange, actually being somewhat closer together than openings 30. By squeezing rods 27 together slightly, the ends thereof can be positioned through holes 32 and releasing the rods thereby allows notches 31 to engage base plate 22. The splash guard is thus easily assembled by sliding rods 27 downwardly through walls 14 and 19 of the motor housing and attaching ring member 23 and base plate 22 as just described, and is likewise easily disassembled for cleaning purposes.

Figure 7:
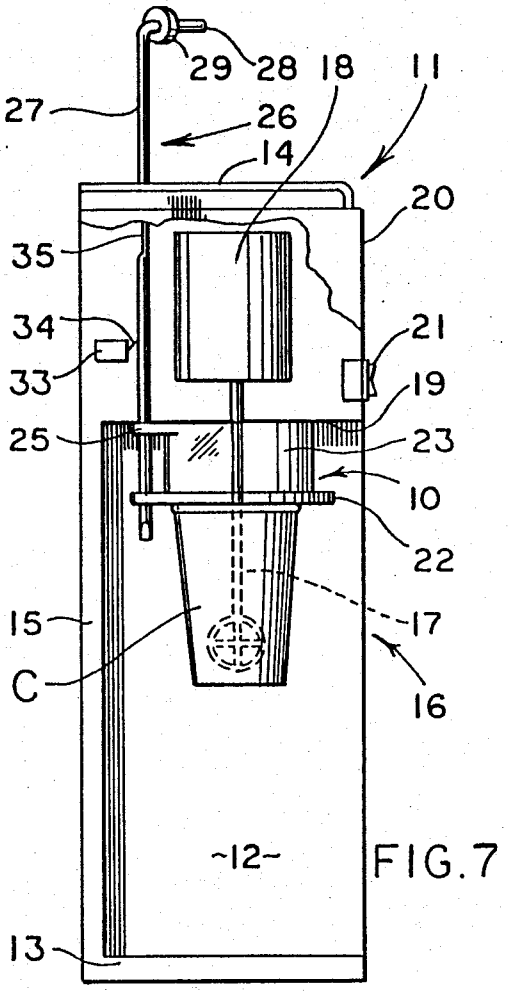
FIG. 7 is a view sequentially following FIG. 6 during the food mixing operation.
Figure 6:
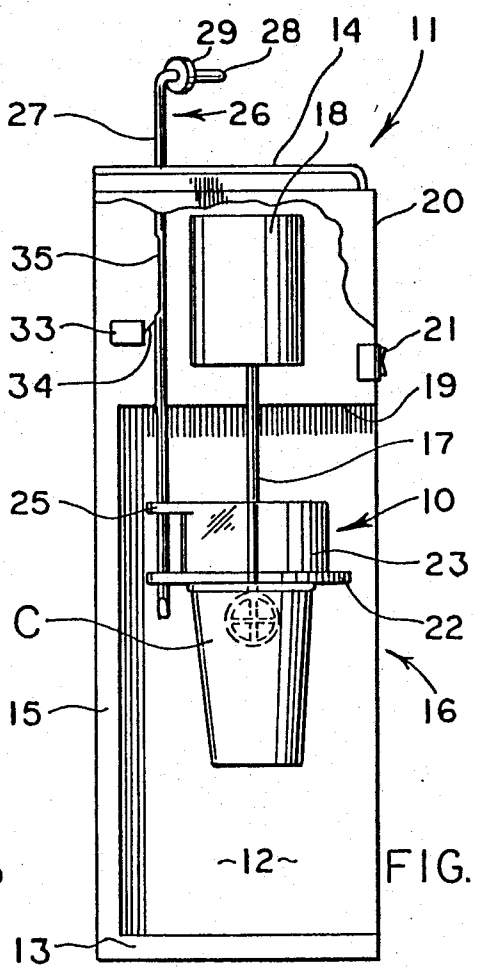
FIG. 6 is a view sequentially following FIG. 5 during the food mixing operation.
Figure 5:
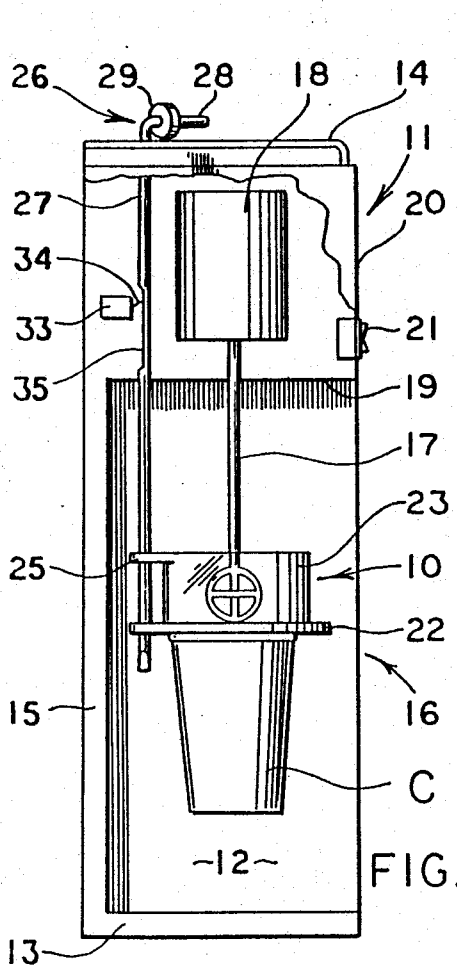
FIG. 5 is a broken away side view of the food mixer and splash guard shown in FIG. 1 at the beginning of the food mixing operation.

The operation of splash guard 10 as agitator 17 is used to mix food in a cup C is best shown in the sequential views, FIGS. 5–7, inclusive. In the normal position, when not in use, splash guard 10 is suspended on rods 27 with ring member 23 totally surrounding agitator 17. At this point, under normal circumstances if switch 21 were turned on, the agitator 17 would begin rotating. However, as shown in FIG. 5, food mixer 10 can be provided with a supplementary or auxiliary control in the form of an electrical interlock trip switch 33 having a switch arm 34 biased outwardly therefrom. One support rod 27 is provided with a notch 35 positioned so that, when in the FIG. 5 off position, switch arm will be biased outwardly into the area of notch 35. With switches 21 and 33 connected in series, if one turns on power switch 21 at this point in time, agitator 17 will not rotate because switch 33 is in the off position.

Figure 1:
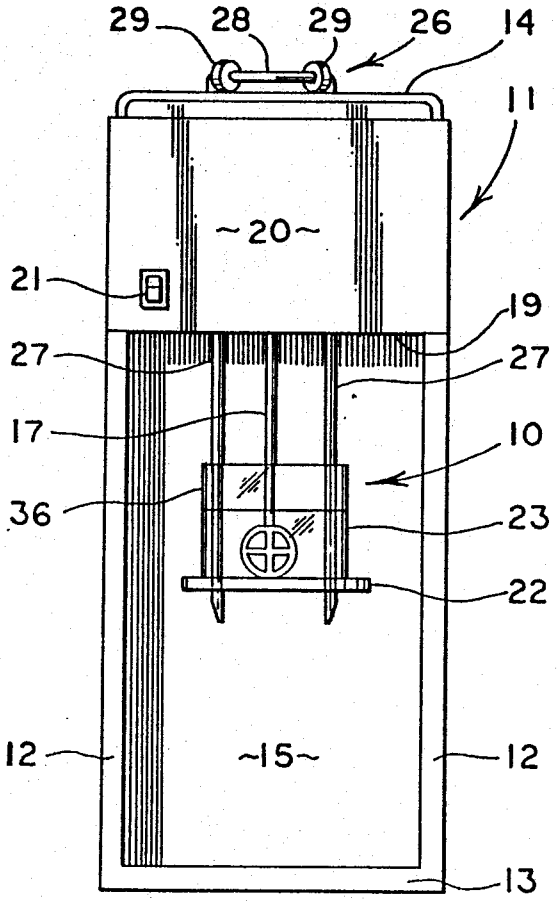
FIG. 1 is a somewhat schematic front view of a food mixer having a splash guard according to the concept of the present invention.

With switch 21 on, but agitator 17 not rotating, the user now positions cup C, as shown in FIG. 5, with the top of the cup against base plate 22 and the opening in the cup under aperture 24 in base plate 22. Upward pressure against base plate 22 causes splash guard 10 and rods 27 to move upward relative to the motor housing as agitator 17 enters cup C. After a predetermined length of travel equivalent to the length of notch 35, rod 27 engages switch arm 34 of switch 33 and completes the power circuit to motor 18 to rotate agitator 17—all as shown in FIG. 6. Continued upward movement, coupled with side to side or circular movement of the cup C, mixes the product in the cup. However, as a safety precaution so that the user does not permit agitator 17 to pierce a hole in the bottom of cup C, the top of ring member 23 engages the bottom 19 of the motor housing to limit upward movement of the cup before the agitator can touch the bottom of the cup, as shown in FIG. 7. Thus, the height of ring member 23 should be such that the top thereof is closer to the bottom 19 of the motor housing than the height of cup C. The ring member 23 shown is designed for use with the largest standard size cup. If smaller cups were used, one merely would need to place an adapter or spacer ring 36 (FIG. 1) on rods 27 above ring member 23 and smaller cups can be accommodated. Of course, the height of adapter ring 36 would depend on the size of the cup. It should also be evident that a single adapter ring 36 could be replaced with cylindrical spacers on each rod 17 and accomplish the same purpose.

When the mixing is completed, lowering of cup C turns off motor 18 as spring arm 34 is allowed to move outward into the notch 35 of a rod 27 and the cup may be removed and used. Any splash which may have occurred is confined on the inside of ring member 23. Of course, if the additional control feature provided by switch 33 is not utilized, the user may manually turn power switch 21 on at any desired point in the cycle. Moreover, the supplemental switch control could be utilized merely to turn the power off at an appropriate time with minor modifications as would be evident to one skilled in the art.

Not only does the 360° splash protection improve the conventional food mixer art, but also it should be appreciated that the present invention affords the opportunity to do away with the food mixer housing and merely, for example, hang a motor housing on a wall with the agitator and splash guard assembly depending therefrom—the food mixer housing not being needed at all for splash protection but only when one desires a free standing unit.

The above-described invention thus accomplishes the objects of the present invention and otherwise improves the art.

We claim:

1. A splash guard for a food mixer, the food mixer having a housing with an agitator extending downwardly therefrom, the splash guard comprising a base plate having an opening therein through which the lower end of the agitator may pass, a ring member positioned above said base plate and surounding the agitator, and means carrying said base plate and said ring member, said means being slidably attached to the housing so that said base plate and said ring member may be vertically moved with respect to the housing.

2. A splash guard according to claim 1 wherein said means includes rod members extending from the housing and engaging said base plate.

3. A splash guard according to claim 2 wherein said base plate is provided with holes through which said rod members pass, said rod members having notches therein to engage said base plate at the location of said holes.

4. A splash guard according to claim 3 wherein said ring member is connected to said base plate and has a flange extending laterally therefrom, said flange being provided with holes through which said rod members pass.

5. A splash guard according to claim 1 wherein the food mixer includes a motor for driving the agitator and a switch for activating the motor, said means including at least one rod member selectively engaging the switch to activate or deactivate the motor.

6. A splash guard according to claim 5, said rod member having a notch along a predetermined length thereof, the switch including a biased switch arm which can engage the rod at all locations except along the length of said notch.

7. A splash guard according to claim 1 wherein the food mixer is used to mix food in a cup, the cup having a predetermined height and an open top to be positioned adjacent said opening in said base plate, said ring member being of a predetermined height such that the top thereof is closer to the housing than the predetermined height of the cup so that the agitator will not pierce the bottom of the cup.

8. A splash guard according to claim 7 further comprising adapter means positioned above said ring member to add to the predetermined height of said ring member.

* * * * *